United States Patent [19]

Mercer

[11] 4,220,333

[45] Sep. 2, 1980

[54] BOWLING PRACTICE AND/OR EXERCISING DEVICE

[76] Inventor: Ronald H. Mercer, 2900 Floral Rd., Lake Worth, Fla. 33462

[21] Appl. No.: 937,994

[22] Filed: Aug. 30, 1978

[51] Int. Cl.[2] ..... A63B 69/00

[52] U.S. Cl. ..... 273/54 B; 35/29 F; 224/45 L; 224/220; 272/119; 273/54 D

[58] Field of Search ..... 273/54 B, 54 D, 64, 273/101.1; 124/5; 224/45 L, 219, 220, 221, 267; 272/119; 35/29 F

[56] References Cited

U.S. PATENT DOCUMENTS

| | | | |
|---|---|---|---|
| 847,467 | 3/1907 | Goodlett | 224/220 |
| 1,192,022 | 7/1916 | Wallenstein | 224/220 |
| 2,302,802 | 11/1942 | Roberts | 224/45 L X |
| 3,033,567 | 5/1962 | Raab | 273/54 B |
| 3,390,470 | 7/1968 | Salo | 273/54 B UX |
| 3,918,618 | 11/1975 | Castaneda | 224/45 L |

FOREIGN PATENT DOCUMENTS

| | | | |
|---|---|---|---|
| 335438 | 4/1921 | Fed. Rep. of Germany | 224/220 |
| 313671 | 1/1934 | Italy | 224/220 |

*Primary Examiner*—Anton O. Oechsle

*Attorney, Agent, or Firm*—Clarence A. O'Brien; Harvey B. Jacobson

[57] ABSTRACT

A bowling practice and/or exercising device in the form of a retaining device for a bowling ball having a wrist encircling strap by which the retaining device is secured to the wrist of a person using the device so that a person can practice and perform various exercises in connection with bowling without the necessity of actually delivering a bowling ball onto a bowling alley or lane. The retainer is in the form of a cage-like structure defined by a plurality of flexible adjustable length straps to receive the bowling ball which would normally be used in actual bowling and an adjustable split wrist band or strap to secure the device to the wrist area of the user with the device being constructed of various materials and including various structural features capable of performing the desired results.

5 Claims, 4 Drawing Figures

BOWLING PRACTICE AND/OR EXERCISING DEVICE

BACKGROUND OF THE INVENTION

1. Field of the Invention

The present invention generally relates to a bowling practicing and/or exercising device which includes a receptacle-like retainer for a bowling ball and a wrist encircling strap for securing the retainer to the wrist area of the user with the bowling ball disposed in the retainer being capable of gripping by the hand of the bowler within the retainer in the normal and conventional manner.

2. Description of the Prior Art

Various devices have been heretofore provided for use by bowlers in practicing or exercising but such devices have usually required that the ball actually be released onto a bowling alley or lane. The following U.S. patents disclose typical structures of this type: U.S. Pat. Nos. 3,033,567; 3,181,864; 3,046,014; 4,034,979.

SUMMARY OF THE INVENTION

An object of the present invention is to provide a bowling practice and/or exercising device which enables a bowler to practice various aspects of bowling and perform various exercises relating to bowling without the necessity of actually releasing the bowling ball onto a bowling alley or lane thereby enabling the performance of such activities in private. The device includes a receptacle-like retainer for an actual bowling ball and a wrist engaging band or strap connected thereto with the structure enabling the hand of the user disposed in the retainer to actually engage, grip and release the bowling ball.

Another object of the invention is to provide a device in accordance with the preceding object in which the wrist engaging band or strap can be circumferentially adjusted and provided with any suitable adjustment means or securing means to facilitate assembly of and removal of the device in relation to the wrist of the user and facilitate adjustment of the device to fit users having different wrist and hand dimension characteristics.

A further object of the invention is to provide a device in accordance with the proceding objects including a light beam producing device mounted below the bowling ball so that the light beam is associated with the bowling ball in a manner to activate one of a series of photocells or the like oriented in front of a user to indicate the "spot" on a bowling alley or lane over which the bowling ball would pass if the bowling ball had been released while the practice device was in a particular path of movement during a practice delivery of the ball.

Still another object of the invention is to provide a bowling practice and/or exercising device in which the bowling ball may be actually released and move away from the hand of the user with the user being able to impart desired spin or other delivery characteristics to the ball with the receptacle-like retainer serving to retain the ball thereby eliminating the necessity of practicing the release portion of the delivery in a bowling alley or lane.

In using the present invention, a user can practice and exercise to correct bowling mistakes or improve their delivery of a bowling ball without performing such activities in public at a bowling alley or lane thereby enabling a user to concentrate more intensely without distraction by other persons which may be present in a bowling alley. It enables practice or exercise with the actual bowling ball or any other object similar in size and weight to the bowling ball so that a person can increase the strength in the arms, fingers, wrist and body muscles which are used while bowling. This device also enables the approach, grip and release of the ball to be practiced while the ball remains contained in the device. This device permits a person to concentrate on their stance, back swing, follow through, release and the like which improves a person's bowling game mentally and physically and increases the confidence of a user when actually bowling. The device can be used by left- or right-handed bowlers, as a body building device and is relatively inexpensive to manufacture but yet is long lasting and effective for its purposes.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
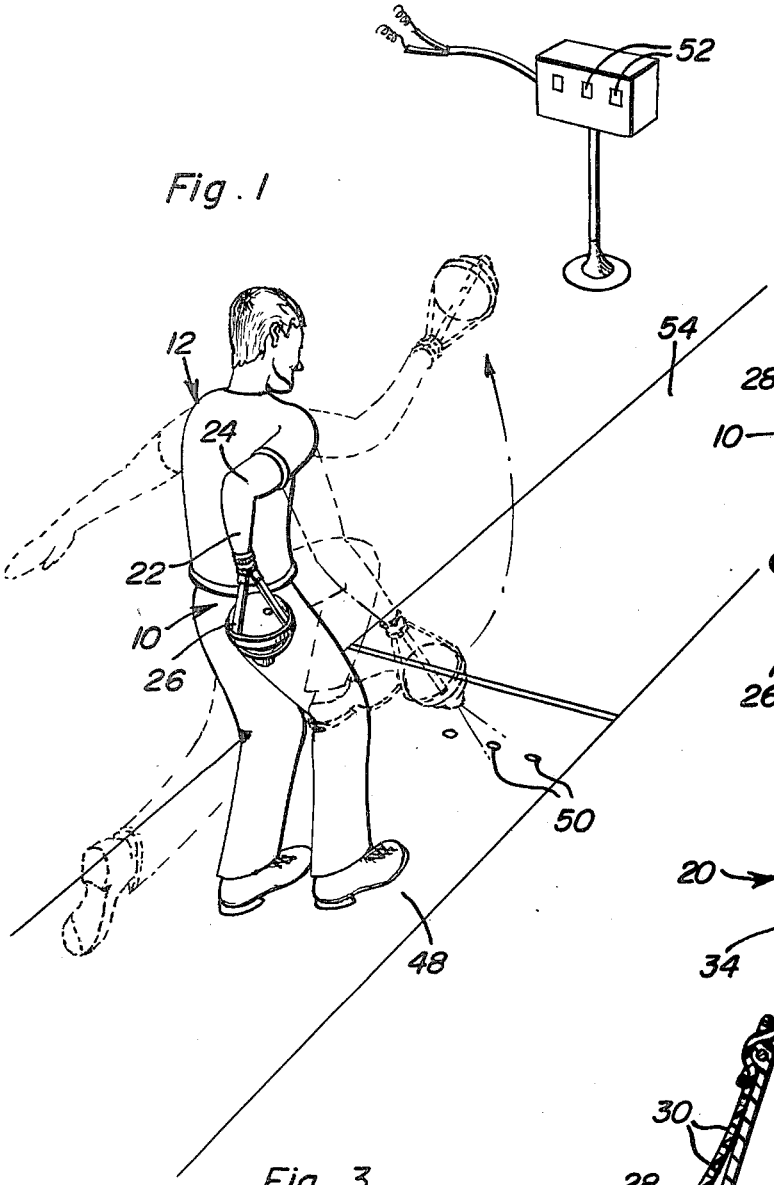
FIG. 1 is a perspective view of the bowling practice and/or exercising device in use by a bowler approaching a simulated foul line and bowling alley which may or may not be present when using this invention.
Figure 2:
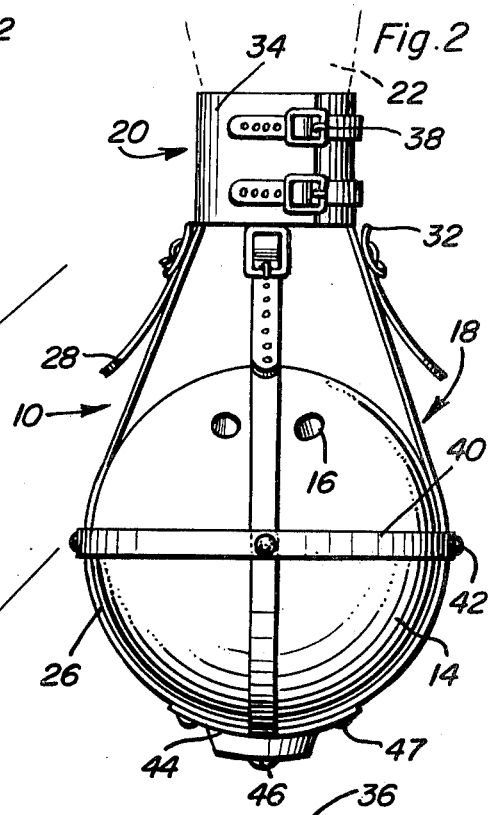
FIG. 2 is an elevational view, on an enlarged scale, illustrating the device of the present invention and its association with a bowling ball.
Figure 3:
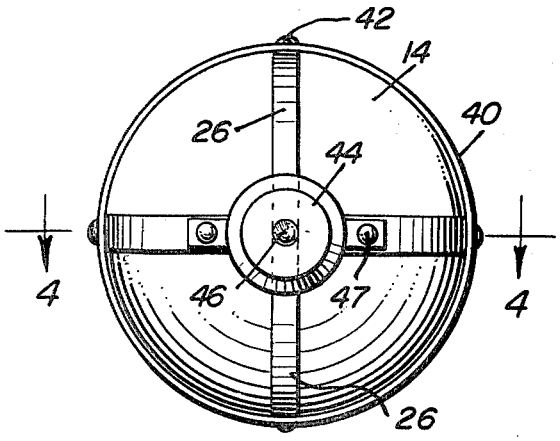
FIG. 3 is a bottom plan view of the device illustrating specific structural details thereof.
Figure 4:
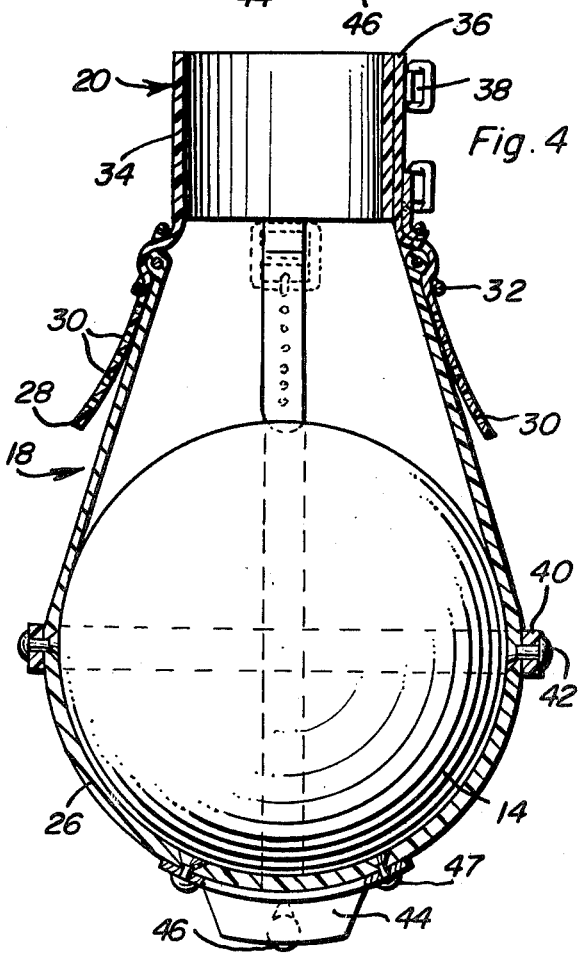
FIG. 4 is a sectional view taken substantially along section line 4—4 on FIG. 3 illustrating additional structural details.

Referring now specifically to the drawings, the bowling practice and/or exercising device of the present invention is generally designated by reference numeral 10 and in FIG. 1, the device is illustrated in use so that a user generally designated by the numeral 12 can practice and/or perform various exercises relating to different aspects of bowling.

The device 10 receives a bowling ball 14 of conventional construction including the finger and thumb receiving openings 16 with the size of the bowling ball being conventional and the weight of the bowling ball also being conventional with the ball 14 preferably being that ball which will actually be used when bowling. A receptacle-like retainer generally designated by numeral 18 receives the bowling ball 14 and a wrist engaging band or strap 20 is connected to the upper end of the retainer and engages the wrist area 22 of the arm 24 of the user 12 with the user's hand and fingers being used to actually grip the ball 14 in a conventional manner while in the retainer 18 with the length of the retainer 18 being adjustable in a manner described hereinafter to enable the bowling ball 14 to be actually released from the grip of the user so that it will move outwardly toward the outer end of the retainer 18 the relatively short distance necessary for the fingers and thumb of the hand of the user to be disengaged from the respective holes 16 in the ball 14.

The retainer 18 includes a plurality of straps 26 of flexible material overlapping and joined together at the outer end thereof or otherwise integrally formed or interconnected. The inner end of each strap 26 is adjustably connected to tabs 28 attached to the wrist band 20 and provided with a plurality of longitudinally spaced apertures 30 therein with a buckle structure 32 or other suitable fastening device being provided on the straps 26 to adjustably connect them with respect to the wrist band 20. The wrist band 20 includes a wide strap 34 having adjustable overlapping end edges 36 which are retained in adjusted position by a pair of strap and buckle assemblies 38. This enables the wrist band to be assembled on the wrist and to be opened to permit insertion and removal of the bowling ball 14. To prevent the straps 26 from permitting the ball 14 passing therebetween, a peripheral strap 40 is connected to an intermediate portion of the straps 26 and generally encircles the bowling ball 14 with suitable fastening means such as rivets 42 of the like securing the strap 40 to the straps 26 at their points of intersection.

The straps and bands can be made of various natural or synthetic materials including any type of fabric, leather, various plastic materials or the like which may be reinforced with metal wire if necessary. For example, the straps and bands may be constructed of polyethylene, rubber, nylon, neoprene or any combination of materials providing the necessary flexibility and strength requirements. The fastening devices may be buckles as illustrated or other various securing devices such as laces, various adhesives, rivets, bolts and any other suitable fastening devices.

As an optional accessory, the bottom of the retainer 18 is provided with a housing 44 having a light 46 provided therein which may be conveniently battery operated and provided with a suitable switch, the details of which are not illustrated. The housing 44 may be permanently or detachably secured in place by fasteners 47 which may be in the form of snap fasteners, rivets or the like. The light 46 is associated with the retainer 18 so that it will illuminate or shine on a particular area of the approach area 48 which has a plurality of photocells or other light sensing devices 50 mounted therein which will energize a corresponding light indicator 52 disposed in front of and elevated in relation to the user 12 so that the user 12 can observe the indicator 52 while his head is in the optimum position during delivery of the ball. Thus, during a particular path of movement of the ball, a particular light sensing device 50 will be energized and a particular indicator light 52 actuated which is indicative of and representative of the "spot" on a bowling alley 54 schematically illustrated in FIG. 1 over which the ball would pass had the ball actually been released by the bowler. This enables spot bowlers to practice their delivery to enable them to more accurately cause the ball to pass over the selected "spot" on the bowling alley. The wrist band or strap 34 may be secured in assembled position by a longitudinal zipper interconnecting the two free end edges thereof and the interior thereof may be provided with a cushioning material such as foam plastic or foam rubber. Other types of fasteners such as snaps, "Velcro" or the like may be used to enable the device to be easily assembled and disassembled in relation to the wrist by the other hand of the bowler. The device is symmetrical so that it can be used by either right- or left-hand bowlers and various types of bowling balls may be used in combination with the device or other weight producing devices may be utilized for practicing and exercising.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A bowling practice and/or exercising device comprising a retainer for receiving a bowling ball and means securing the retainer to the wrist area of a user to enable the bowling ball in the retainer to be swung in an arcuate path simulative of actually delivering a bowling ball with the retainer retaining the bowling ball adjacent the hand of the user throughout the delivery wherein the outer end of the retainer includes light means for projecting a light beam axially outwardly therefrom, a plurality of transversely spaced light sensing means positioned in the approach path of a user to be energized by the light beam emitted from the light means during the practice delivery of the bowling ball, an indicator means generally at eye level of the user to enable the user to observe which of the light sensing means was energized for indicating the "spot" on the bowling alley over which the ball would have passed had the ball actually been released onto the bowling alley, enabling the user to practice and/or exercise various aspects of bowling without requiring the use of a bowling alley.

2. A bowling practice and/or exercising device comprising a retainer for receiving a bowling ball and means securing the retainer to the wrist area of a user to enable the bowling ball in the retainer to be swung in an arcuate path simulative of actually delivering a bowling ball with the retainer retaining the bowling ball adjacent the hand of the user throughout the delivery wherein said retainer is in the form of a receptacle-like member, said means securing the retainer to the wrist area including a split wrist band encircling the wrist area and including means to secure the wrist band in place on the wrist area of the user, said receptacle-like member is being in the form of a plurality of longitudinally extending straps having their end portions connected with the wrist band and their central portions intersecting at the outer end of the retainer, said retainer having sufficient interior space to provide the hand of the user on which the retainer is mounted with freedom of movement to grip the bowling ball within the retainer in the conventional and natural manner used when delivering a bowling ball onto a bowling alley with the longitudinal dimension of the retainer being adequate to enable the bowling ball to move a limited distance when released during a practice delivery so that the bowling ball may move just beyond the fingers of the user's hand when the user releases the grip on the ball, enabling the user to practice and/or exercise various aspects of bowling without requiring the use of a bowling alley.

3. The structure as defined in claim 2 together with a peripheral strap anchored to the longitudinal straps and encircling a central portion of a bowling ball positioned interiorly of the straps.

4. The structure as defined in claim 3 together with adjustable means connecting the longitudinal straps to the wrist band to enable variation in the length of the retainer whereby the bowling ball can be gripped by the hand of the user while within the retainer.

5. The structure as defined in claim 4 wherein said split wrist band is secured in adjusted position by a pair of adjustable length strap and buckle assemblies.

* * * * *